US005103869A

United States Patent [19]

Kimura et al.

[11] Patent Number: 5,103,869

[45] Date of Patent: Apr. 14, 1992

[54] PIEZOELECTRIC ON-OFF VALVE FOR AIR CONDITIONING

[75] Inventors: Yoshimichi Kimura, Chiba; Yuzo Kimoto, Tokyo; Yukio Sato, Chiba; Yukio Anekoji, Kanagawa; Osamu Yabuta, Saitama; Mitsuhisa Fukuda, Chiba; Shoji Hirose, Miyagi; Takao Chiba, Tokyo, all of Japan

[73] Assignees: Toshiba Ceramics Co., Ltd.; Shin Nippon Air Conditioning Engineering Co., Ltd., both of Tokyo, Japan

[21] Appl. No.: 592,742

[22] Filed: Oct. 4, 1990

[30] Foreign Application Priority Data

Oct. 27, 1989 [JP] Japan ..... 1-278719

[51] Int. Cl.[5] ..... F16K 31/02; F24F 13/068

[52] U.S. Cl. ..... 137/625.28; 251/129.06; 251/208; 454/297; 454/303; 454/324

[58] Field of Search ..... 251/129.06, 208; 98/40.11, 40.16, 41.3; 137/625.45, 625.28

[56] References Cited

U.S. PATENT DOCUMENTS 2,466,851 4/1949 Honerkamp et al. ..... 98/41.3
4,492,360 1/1985 Lee, II et al. ..... 251/129.06
4,617,952 10/1986 Fujiwara et al. ..... 251/129.06 X
4,787,071 11/1988 Kreuter et al. ..... 251/129.06 X
4,955,286 9/1990 Muller et al. ..... 98/40.11

FOREIGN PATENT DOCUMENTS 63-243653 10/1988 Japan .

OTHER PUBLICATIONS

Mariner, Dr. Thomas, "Plenum Engineering-A Key to Success with Ventilating Ceilings", Heating, Piping & Air Conditioning, pp. 150-151, Oct. 1962.

*Primary Examiner*—Arnold Rosenthal
*Attorney, Agent, or Firm*—Finnegan, Henderson, Farabow, Garrett and Dunner

[57] ABSTRACT

A piezoelectric on-off value for air conditioning comprises a bendable metal plate fixed at one end thereof; a valve member mounted on the other end of the metal plate along a ceiling plate, the value member having vent holes corresponding to vent holes in the ceiling plate, and the valve member changing the relative closure of the vent holes when the metal plate is deformed by application of voltage to the piezoelectric ceramic.

6 Claims, 5 Drawing Sheets

FIG. 5 (b) PRIOR ART

PIEZOELECTRIC ON-OFF VALVE FOR AIR CONDITIONING

BACKGROUND OF THE INVENTION

This invention relates to a ventilating ceiling system for air conditioning. More specially, it relates to a piezoelectric on-off valve for air conditioning.

Recently, in building offices and factories, there has been a demand for interior air conditioning environments that are suited for the kinds of work performed therein in view of computer usage and consideration of the productivity and human environments.

In a conventional air conditioning control system, air is fed by an air blower, provided for the whole of the factory or the building or for each floor, through ducts, and a motor-actuated damper is provided at a ceiling space of each room, and the air is supplied into the room through vent holes provided in a ceiling plate.

However, conventionally, the feed of the air to the ceiling space of each room is adjusted only by the motor-actuated damper, and therefore a pressure loss may develop due to the positional relation between the motor-actuated damper and the duct, so that it has been difficult to obtain a uniform amount of the air at any of the vent holes in the ceiling plate. In addition, this problem becomes more conspicuous with an increase of the size of the room.

To overcome this problem, the ceiling space can be partitioned into an increased number of areas and to complicate the arrangement of the motor-actuated damper and the duct. However, such means increases the cost of the system.

SUMMARY OF THE INVENTION

The present invention has been made in order to overcome the above problems, and an object of the invention is to provide a piezoelectric on-off valve for air conditioning which can effect a uniform and precise control of the air amount.

According to the present invention, there is provided a piezoelectric on-off valve for air conditioning, comprising a bendable metal plate fixedly secured at one end thereof, said plate being substantially perpendicular to a surface of a ceiling plate with vent holes; a piezoelectric ceramic mounted on a surface of said metal plate; and a valve member mounted on the other end of said metal plate along said ceiling plate, said valve member having vent holes corresponding to said vent holes in said ceiling plate, and said valve member changing the relative closure of said vent holes when said metal plate is deformed by application of voltage to said piezoelectric ceramic.

In the present invention, examples of the material for the metal plate includes iron-nickel alloy, brass and stainless steel. Preferably, the piezoelectric ceramic is made of a material having a high piezoelectric constant, that is, a high displacement amount relative to voltage applied per unit area.

In the piezoelectric on-off valve for air conditioning according to the present invention, the piezoelectric ceramic is mounted on one side of the metal plate mounted on the ceiling plate in perpendicular relation thereto, and upon application of DC voltage to the piezoelectric ceramic, the metal plate is deformed, and by this deformation, the valve member mounted on the free end of the metal plate slides along the ceiling plate. The ceiling plate and the valve member have the vent holes of the same shape. With respect to the vent holes, the width (i.e., the width in the direction of deformation of the metal plate) is set to a value substantially equal to the amount of displacement of the metal plate, and the shape of the vent hole is not particularly limited. When DC voltage is not applied to the piezoelectric ceramic, the vent holes in the ceiling plate and the vent holes in the valve member are disposed out of registry with each other, thus closing the vent holes. When DC voltage is applied to the piezoelectric ceramic, the vent holes in the ceiling plate are brought into registry with the vent holes in the valve member, thereby opening the vent holes. The degree of opening of the vent holes is controlled by the magnitude of the voltage applied to the piezoelectric ceramic.

Although such a piezoelectric on-off valve for air conditioning is very simple in construction, a precise control of the air amount per vent hole can be effected by the voltage driving. For example, as an on-off valve driven by applying voltage to a piezoelectric ceramic as in the piezoelectric on-off valve for air conditioning according to the present invention, it can be proposed one in which a metal plate is mounted at one end on a ceiling plate therealong, and a piezoelectric ceramic is mounted on a surface of the metal plate, and a valve member corresponding to a vent hole in the ceiling plate is mounted the other end (free end) of the metal plate, and by applying DC voltage to the piezoelectric ceramic, the metal plate is deformed upwardly to open the vent hole. However, in such an on-off valve, the metal plate and the valve member are liable to be influenced by the wind pressure, and therefore particularly when the applied voltage is low, a precise control of the air amount is difficult, and also the air amount is small. On the other hand, in the on-off valve of the present invention, the influence of the wind pressure is small, and even when the applied voltage is low, a precise control of the air amount is possible, and a large amount of the air can be obtained. Further, the piezoelectric on-off valve for air conditioning according to the present invention is lightweight, and can be installed easily, and consumes a small amount of electric power. Therefore, there is not encountered a great cost increase due to the partitioning of the ceiling space into an increased number and to a complicated arrangement of the motor-actuated damper and the duct. Further, a temperature sensor or a moisture sensor can be used in combination with this on-off valve, and the design of the control system can be done easily.

BRIEF DESCRIPTION OF THE DRAWINGS

FIG. 1(*b*) is a cross-sectional view of FIG. 1(*a*);

FIG. 2(*b*) is a cross-sectional view of FIG. 2(*a*);

FIG. 5(*b*) is a cross-sectional view of FIG. 5(*a*); and

DETAILED DESCRIPTION OF THE PREFERRED EMBODIMENTS

Figure 1A:
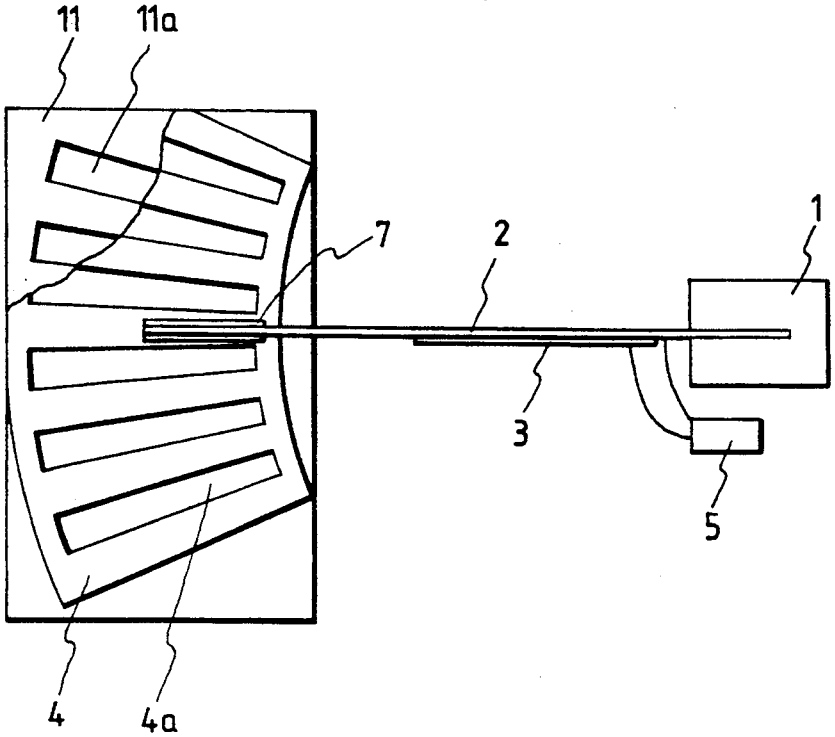
FIG. 1(*a*) is a plan view showing a preferred embodiment of a piezoelectric on-off valve for air conditioning of the present invention, mounted on a ceiling plate, with voltage not being applied.
Figure 1B:
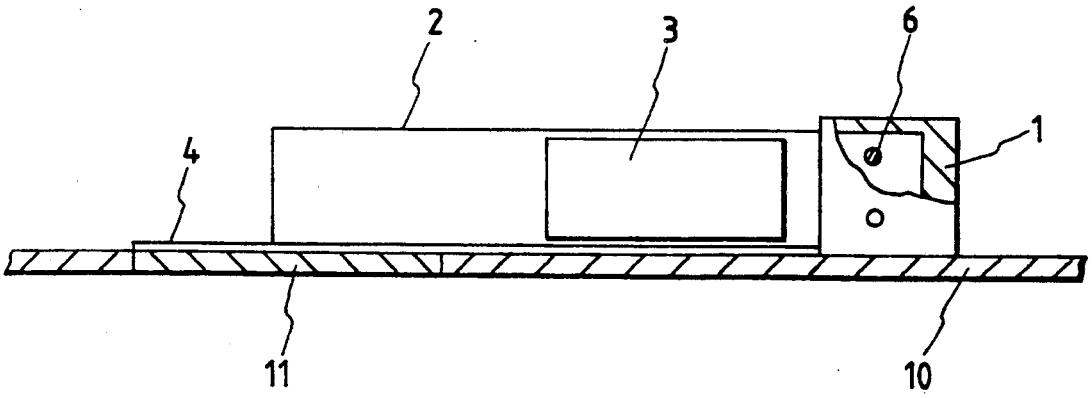
Figure 2A:
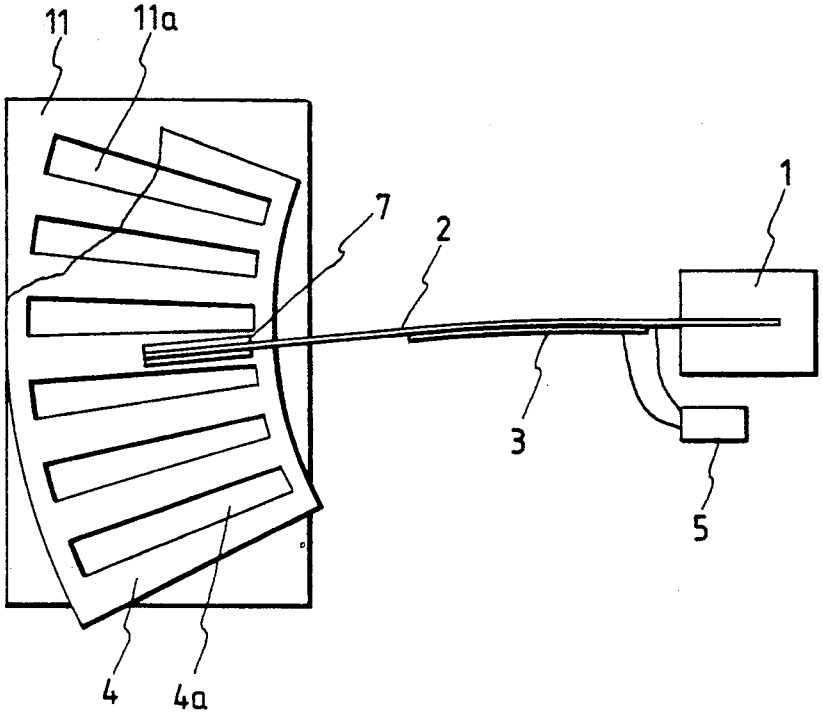
FIG. 2(*a*) is a plan view showing the piezoelectric on-off valve for air conditioning according to the present invention, mounted on the ceiling plate, with voltage applied.
Figure 2B:
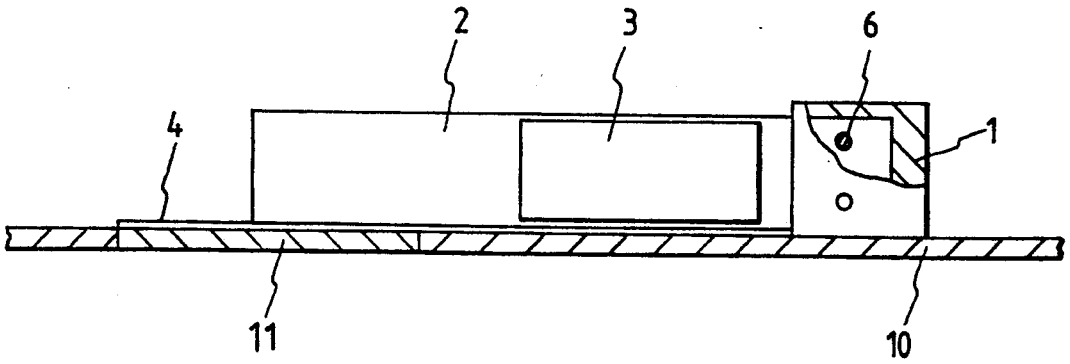

An embodiment of the invention will now be described with reference to the drawings. FIG. 1(*a*) is a plan view showing a piezoelectric on-off valve for air conditioning according to the present invention, mounted on a ceiling plate, with voltage not being applied. FIG. 1(*b*) is a cross-sectional view of FIG. 1(*a*). FIG. 2(*a*) is a plan view showing the piezoelectric on-off valve for air conditioning according to the present invention, mounted on the ceiling plate, with voltage applied. FIG. 2(*b*) is a cross-sectional view of FIG. 2(*a*).

In FIGS. 1 and 2, a ventilation plate 11 is attached to the ceiling plate 10, and the ventilation plate 11 has six slit-like vent holes 11*a*. A fixing base 1 of a plastic material is mounted on the ceiling plate 10, and a metal plate 2 (120 mm×30 mm×0.2 mm) of iron-nickel alloy is fixedly secured at one end to the fixing base 1 by screws 6, the metal plate 2 being disposed perpendicular to the ceiling plate 10. The other end (free end) of the metal plate 2 is extended toward the ventilation plate 11. A piezoelectric ceramic 3 (75 mm×28 mm×0.2 mm) (T-99 sold by Toshiba Ceramics Corporation) is bonded to one side of the metal plate 2. A DC power source 5 is connected to the opposite sides of the piezoelectric ceramic 3. A valve member 4 of a plastic material is secured to the other end of the metal plate 2 by an adhesive 7, the valve member 4 being slidable along the ventilation plate 11. The valve member 4 has six slit-like vent holes 4*a* identical in shape to the vent holes 11*a* of the ventilation plate 11.

The opened and closed conditions of this piezoelectric on-off valve for air conditioning will now be described with reference to FIG. 1(*a*) and FIG. 2(*a*). Namely, when DC voltage is not applied to the piezoelectric ceramic 3, the metal plate 4 is not deformed, and the vent holes 4*a* of the valve member 4 are out of registry with the vent holes 11*a* of the ventilation plate 11, and therefore the valve member closes the vent holes 11*a*, as shown in FIG. 1(*a*). On the other hand, when DC voltage is applied to the piezoelectric ceramic 3, the metal plate 2 is deformed as shown in FIG. 2(*a*), and the vent holes 4*a* of the valve member 4 are brought into registry with the vent holes 11*a* of the ventilation plate 11, respectively, so that the vent holes 11*a* are opened. Since the amount of deformation (displacement) of the metal plate 2 can be controlled by the magnitude of the applied voltage, the deformation can be in a condition intermediate the condition of FIG. 1(*a*) and the condition of FIG. 2(*a*), and therefore the amount of the air can be controlled precisely.

Figure 5A:
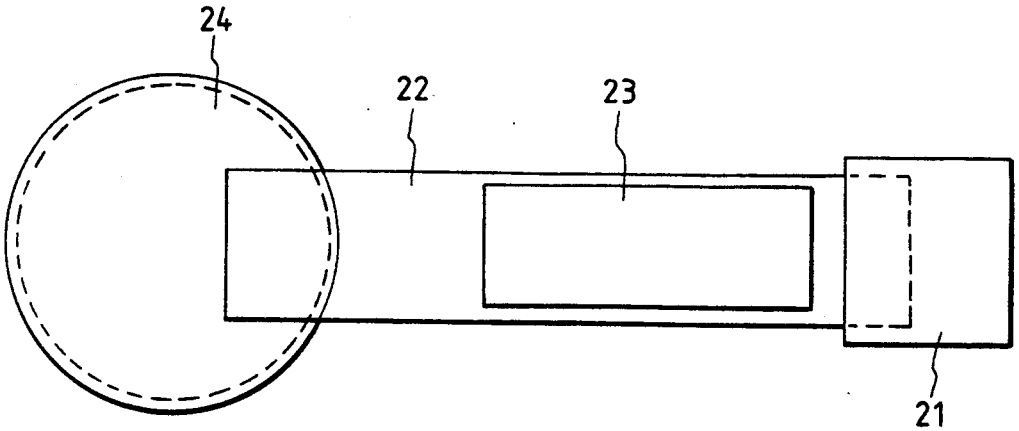
FIG. 5(a) PRIOR ART
FIG. 5(*a*) is a plan view of a valve member-type piezoelectric on-off valve for air conditioning.
Figure 5A:
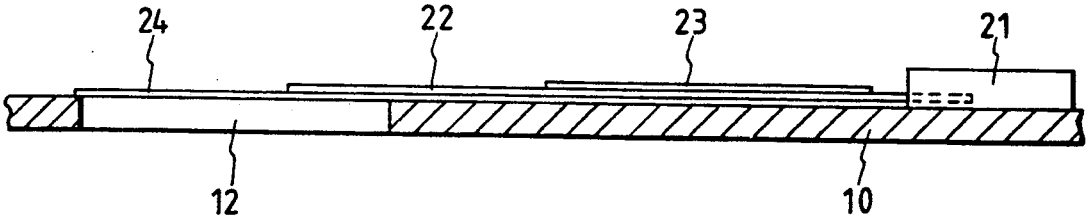
FIG. 5(a) PRIOR ART

For the purpose of comparison with the piezoelectric on-off valve for air conditioning according to the present invention, a typical prior art piezoelectric on-off valve for air conditioning is shown in FIGS. 5(*a*) and 5(*b*). In FIGS. 5(*a*) and 5(*b*), a vent hole 12 having a diameter of 40 mm is formed through a ceiling plate 10. A fixing base 21 is mounted on the ceiling plate 10. A metal plate 22 having a length of 150 mm, a width of 20 mm and a thickness of 0.3 mm is fixedly secured at one end to the fixing base 21, the metal plate 22 extending along the ceiling plate 10. The other end (free end) of the metal plate 22 is extended toward the vent hole 12. A piezoelectric ceramic 23 having a length 65 mm, a width of 10 mm and a thickness of 0.3 mm is bonded to an upper surface of the metal plate 22. A valve member 24 having a diameter of 44 mm is secured to a lower surface of the other end of the metal plate 22. In this air piezoelectric on-off valve for air conditioning, the metal plate 22 is not deformed when DC voltage is not applied to the piezoelectric ceramic 23, and the valve member 24 closes the vent hole 12. On the other hand, when DC voltage is applied to the piezoelectric ceramic 23, the metal plate 22 is deformed upwardly, thereby opening the vent hole 12.

The piezoelectric on-off valve for air conditioning according to the present invention (hereinafter referred to as "slit-type") and the prior art piezoelectric on-off valve for air conditioning of FIG. 5 (hereinafter referred to as "valve member-type") were used, and each type of on-off valves were attached to that portion of the ceiling plate, corresponding to a central 3-mat portion of a ten-mat room, at a density of 128 valves per mat, and a pressure differential between the ceiling space and the room space was 1 mmAq. In this condition, the amount of the air in the room relative to the applied voltage was measured, and results thereof are shown in FIG. 6.

Figure 6:
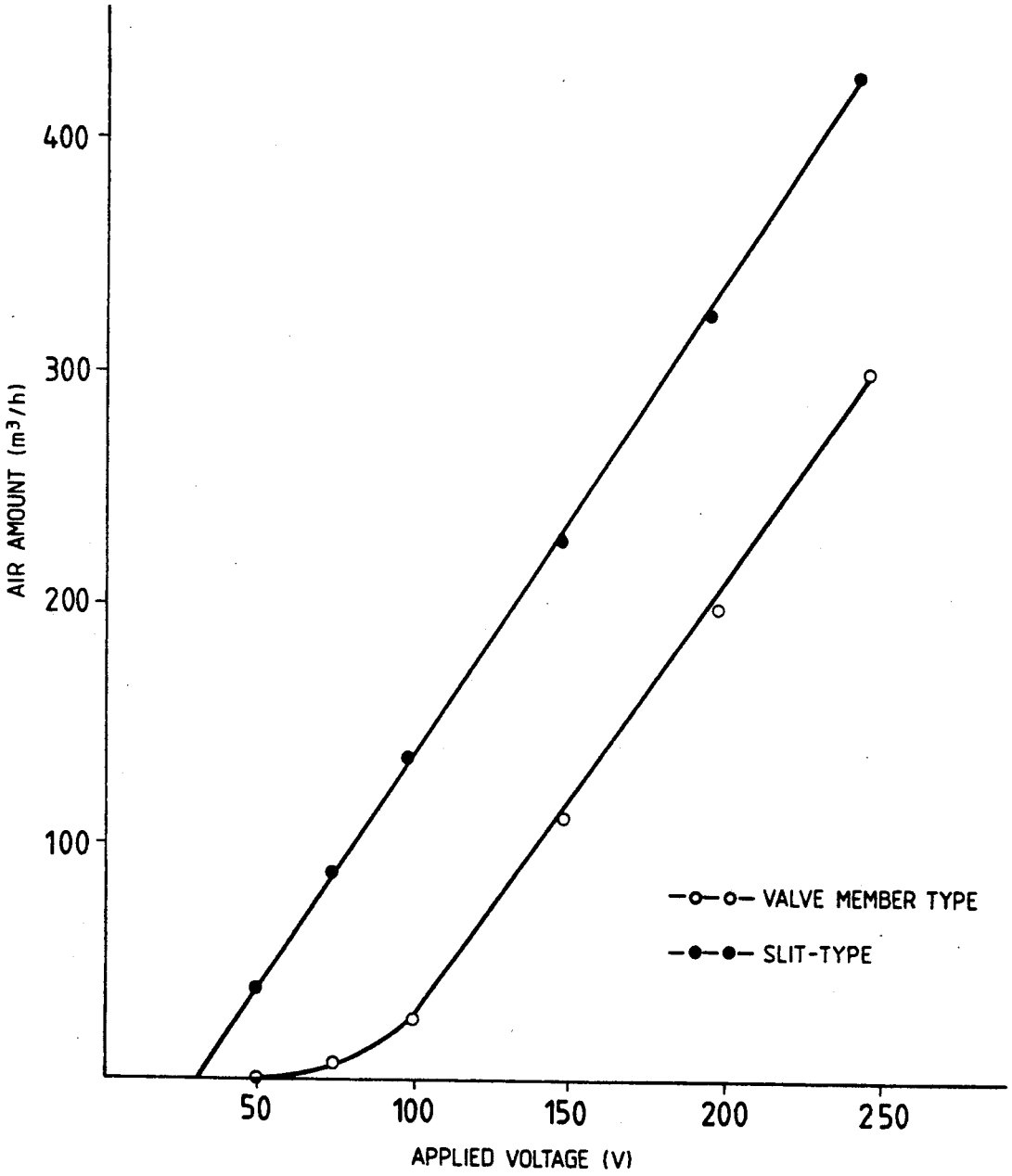
FIG. 6 is a characteristics illustration showing the relation between the applied voltage and the amount of the air with respect to the piezoelectric on-off valve for air conditioning according to the present invention and the valve member-type piezoelectric on-off valve.

As is clear from FIG. 6, in the prior art valve member-type, at low voltages, the relativity of the air amount to the voltage is poor, and also the air amount is small. This is due to the fact that in the valve member-type, the valve member and the metal plate are influenced by the wind pressure, so that the efficiency of opening of the vent hole by the valve member is lowered. Therefore, in order to obtain a large amount of the air, it is necessary to increase the size of the vent hole and the valve member, to increase the number of these, and to increase the length of the metal plate. This invites disadvantages such as difficulty of manufacture.

On the other hand, in the slit-type of the present invention, a loss due to wind pressure load is small, and the efficiency of opening of the vent holes by the valve member is high, and therefore even at low voltages, the relativity between the voltage and the air amount in the room is good, and the air amount is large.

Figure 3:
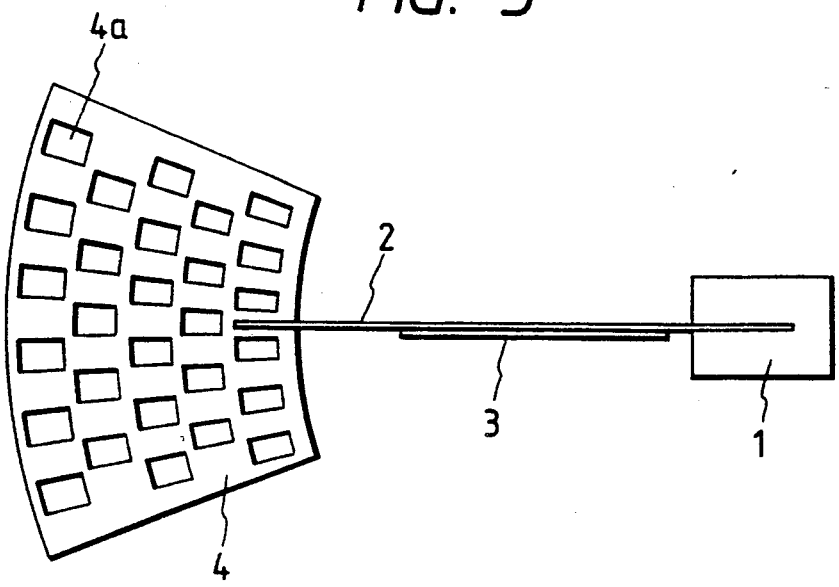
FIGS. 3 and 4 are plan views of modified piezoelectric on-off valves for air conditioning, respectively.
Figure 4:
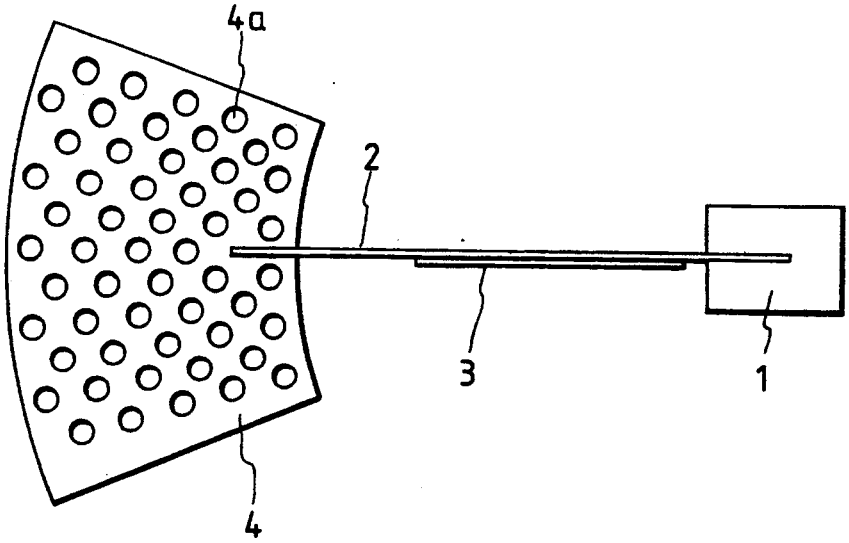

The piezoelectric on-off valve for air conditioning according to the present invention is not restricted to the above-mentioned embodiment, and various modifications can be made. For example, with respect to the shape of the vent hole 4*a*, it may have a square shape as shown in FIG. 3, and also may have a circular shape as shown in FIG. 4. The use of such vent holes is advantageous in narrowing streams of the air. With respect to the metal plate and the piezoelectric ceramic, a bimorph element may be used if the amount of displacement is considered as being important. Further, in the above embodiment, although the on-off valve is mounted directly on the ceiling plate, the on-off valve of a larger size may be provided in the ceiling space, in which case the ceiling plate having narrow holes is disposed below the on-off valve, thereby narrowing streams of the air.

As described above, by the use of the piezoelectric on-off valve for air conditioning according to the present invention, a highly precise and reliable air amount control can be achieved without greatly increasing the cost, and in combination with a sensor or the like, the design of the control system can be made easily. Thus, these advantages can be achieved.

What is claimed is:

1. An air conditioning air flow control system comprising:

a ventilation plate having a plurality of vent apertures and adaptable to be supported to direct air to a space to be air conditioned;

a valve plate having a plurality of valve apertures, each corresponding to a respective one of said vent apertures in said ventilation plate; said valve plate being slidably movable relative to said ventilation plate;

a drive plate coupled to said valve plate and adapted to be deflected to cause sliding movement of said valve plate relative to said ventilation plate so that said valve apertures can move into and out of registration with said ventilation apertures;

a power source generating a voltage; and piezoelectric means electrically connected to said power source and mechanically coupled to said drive plate, to control deflection of said drive plate, the extent of the deflection dependent on the voltage applied to said piezoelectric means.

2. The air conditioning air flow control system of claim 1, wherein said drive plate extends upwardly with respect to said valve plate and perpendicular to the lateral direction of said valve plate.

3. The air conditioning air flow control system of claim 1, wherein said vent apertures and said valve apertures are rectangular.

4. The air conditioning air flow control system of claim 1, wherein each of said vent apertures and said valve apertures comprises a slit.

5. The air conditioning air flow control system of claim 1, wherein said piezoelectric means is affixed to said drive plate.

6. An air flow control arrangement for an air conditioning system, said arrangement comprising:

a ventilation plate having a plurality of vent apertures;

a valve plate having a plurality of valve apertures, each corresponding to a respective one of said vent apertures;

means for supporting said valve and ventilator plates in generally parallel relation for sliding movement relative to each other so that said valve and vent apertures can be moved into and out of registration to control air flow therethrough:

a voltage source;

elongated piezoelectric means being electrically connected to said voltage source and being deflectable along its longitudinal axis in response to applied voltage; and drive means for coupling said piezoelectric means to at least one of said plates to drive said one plate in sliding movement relative to the other plate, the relative positioning of said plate apertures depending on the extent of sliding movement of said one plate which in turn depends on the voltage applied to said piezoelectric means.

* * * * *

UNITED STATES PATENT AND TRADEMARK OFFICE

CERTIFICATE OF CORRECTION

PATENT NO. : 5,103,869

DATED : April 14, 1992

INVENTOR(S) : Yoshimichi Kimura et al.

It is certified that error appears in the above-identified patent and that said Letters Patent is hereby corrected as shown below:

Abstract, line 1, change "value" to --valve--.

Abstract, line 4, change "value" to --valve--.

Claim 1, column 5, line 1, change "system" to --system,--.

Signed and Sealed this

Fifth Day of October, 1993

Bruce Lehman

*Attest:*

BRUCE LEHMAN

*Attesting Officer*

*Commissioner of Patents and Trademarks*